US007986900B2

(12) United States Patent
Holmes et al.

(10) Patent No.: US 7,986,900 B2
(45) Date of Patent: Jul. 26, 2011

(54) METHODS FOR SEALING TONER OPENING PORTS OF PRINTER CARTRIDGES

(75) Inventors: Denny Holmes, Los Angeles, CA (US); Tigran Ohanyan, Van Nuys, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 0 days.

(21) Appl. No.: 12/924,640

(22) Filed: Oct. 1, 2010

(65) Prior Publication Data

US 2011/0026965 A1 Feb. 3, 2011

Related U.S. Application Data

(62) Division of application No. 11/894,414, filed on Aug. 21, 2007, now Pat. No. 7,835,664.

(51) Int. Cl.
*G03G 15/00* (2006.01)
*G03G 15/06* (2006.01)

(52) U.S. Cl. ..... 399/109; 399/106

(58) Field of Classification Search ..... 399/109, 399/106, 262

See application file for complete search history.

(56) References Cited

U.S. PATENT DOCUMENTS

| | | | | |
|---|---|---|---|---|
| 4,895,104 | A * | 1/1990 | Yoshino et al. | 399/106 |
| 5,184,182 | A * | 2/1993 | Michlin | 399/262 |
| 5,206,619 | A * | 4/1993 | Kita | |
| 5,258,814 | A * | 11/1993 | Davies | 399/109 |
| 5,263,517 | A * | 11/1993 | Ishikawa et al. | 399/106 |
| 5,878,306 | A * | 3/1999 | Michlin | 399/106 |
| 6,044,238 | A * | 3/2000 | Rodriguez | 399/106 |
| 6,552,780 | B1 * | 4/2003 | Michlin et al. | 399/106 |
| 6,925,273 | B1 * | 8/2005 | Michlin et al. | 399/106 |
| 7,123,855 | B2 * | 10/2006 | Yuan et al. | 399/106 |
| 2006/0204274 | A1 * | 9/2006 | Jones et al. | 399/106 |
| 2007/0140730 | A1 * | 6/2007 | Jones et al. | 399/106 |

* cited by examiner

*Primary Examiner* — Susan Lee

(57) ABSTRACT

A method of sealing a toner opening port of a printer cartridge is provided for inserting a seal through a toner exit port leading to the toner opening port which is configured to be covered by a toner exit port plug. The seal has a seal frame and a first pull tab attached to the seal frame with a first adhesive, and a second pull tab attached to the seal frame with a second adhesive, the second adhesive being different from the first adhesive. The method further provides for detaching the second pull tab from the seal frame, allowing the first pull tab to cover the toner opening port, and applying pressure with a seal clamp to the seal thereby allowing the seal to attach to the printer cartridge.

12 Claims, 9 Drawing Sheets

METHODS FOR SEALING TONER OPENING PORTS OF PRINTER CARTRIDGES

CROSS REFERENCE TO RELATED APPLICATION

This application is a divisional of prior application Ser. No. 11/894,414, filed Aug. 21, 2007, which is incorporated herein by reference in its entirety.

FIELD OF INVENTION

The present invention relates to electrophotography, particularly methods and apparatus for sealing toner opening ports of printer cartridges

BACKGROUND

Used printer cartridges of fax machines, copiers, inkjet printers, and laser printers are often remanufactured. The remanufacturing of printer cartridges may include cleaning, repairing damaged parts, replacing worn parts, and adding toner. Toner is usually added into the printer cartridge by pouring toner into a toner hopper, which defines a toner opening port. During or after remanufacturing, the toner opening port usually has to be sealed so that toner will not leak during shipment and anytime prior to the use of the cartridge.

Existing toner opening port sealing methods include using split seals and insertion seals. The use of split seals requires splitting a printer cartridge portions, such as the mag roller section and the toner hopper, so that the toner opening port can be accessed to install the split seal. The use of a split seal often involves more resources than the use of insertion seals, as time and labor need to be spent on splitting the cartridge and reassembling the split cartridge. Some re-manufacturers prefer the use of insertion seals.

Insertion seals do not require splitting of cartridges, and are typically installed in the cartridge by inserting them through toner exit ports. Toner exit ports are openings that are adjacent to the toner opening ports and that lead to the toner opening ports. In some cartridges, toner exit port plugs are used to cover and prevent toner leakage around the toner exit ports. At least one problem with the use of existing insertion seals is that when they are detached from the cartridge just before use, insertion seals pull along with them the toner exit port plugs. The toner exit port plugs get displaced, and toner is allowed to leak. A sealing method and seal that substantially maintain the position of the toner exit plug during seal removal are desired and are addressed by the present invention.

SUMMARY

A method of sealing a toner opening port of a printer cartridge, the method comprising inserting a seal through a toner exit port, the toner exit port leading to the toner opening port, the toner exit port being configured to be covered by a toner exit port plug, the seal comprising a seal frame and a first pull tab attached to the seal frame with a first adhesive, the seal further comprising a second pull tab attached to the seal frame with a second adhesive, the second adhesive being a different type of adhesive from the first adhesive; allowing the first pull tab to cover the toner opening port; detaching the second pull tab from the seal frame; and applying pressure to the seal frame thereby allowing the second adhesive to attach the seal frame to the printer cartridge, wherein the first pull tab is configured to be detached from the seal frame without substantially adhering to the toner exit port plug.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DETAILED DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

Figure 1:
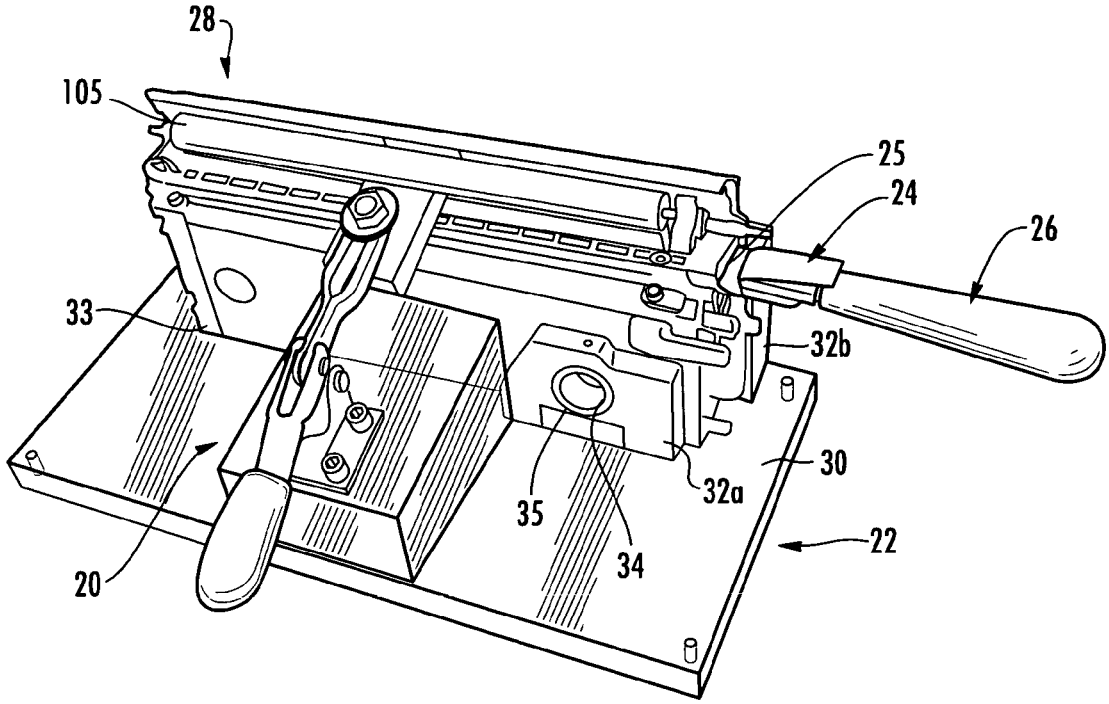
FIG. 1 is substantially a perspective view of an embodiment of an apparatus for sealing toner opening ports of the present invention.

The present invention comprises methods and apparatus for sealing toner opening ports of printer cartridges. Referring to FIG. 1, the preferred embodiment of the apparatus for sealing toner opening ports of printer cartridges preferably includes a seal 24, a seal insertion tool 26, a seal clamp 20, and a fixture 22. The seal 24 is preferably an insertion type seal, which means that it can be installed without having to split apart portions of the printer cartridge 28, such as the mag roller portion and the toner hopper. The seal 24 preferably provides a seal for the toner opening port (not shown) of the printer cartridge 28 so that toner is substantially prevented from leaking or escaping from the toner hopper prior to the use of the printer cartridge 28. Upon the first use of the printer cartridge 28, the portion of the seal 24 that covers the toner opening port may be detached from the printer cartridge 28.

The seal 24 may be installed by inserting it through the toner exit port 25, which leads to the toner opening port. The seal 24 may then be attached to the printer cartridge portion that surrounds the toner opening port. The seal insertion tool 26 preferably aids in the insertion of the seal through the toner exit port 25. The seal clamp 20 preferably provides substantially uniform pressure to the seal 24 so that the seal 24 can adhere substantially well to the printer cartridge 28, and toner leakage can substantially be prevented. The seal clamp 20 may be attached to the fixture 22, which may provide support to the printer cartridge 28 at least while the seal is being attached to it. The fixture 22 may also be configured to provide support to the printer cartridge 28 while other remanufacturing work is being performed on the printer cartridge 28, such as when toner is being refilled.

Fixture

The fixture 22 is preferably configured to support the printer cartridge 28 with its base 30 and walls 32*a-c*. The walls 32*a-c* of the fixture 22 may be attached perpendicular to the base 30 and may substantially prevent or substantially minimize movements of the printer cartridge 28 during the sealing process. One of the fixture walls, 32*a*, is preferably configured to be positioned adjacent to the toner hopper 33. Fixture wall 32*a* preferably defines a toner refill hole template 34. A hole saw (not shown) may be attached to an electric drill (not shown) and inserted into the toner refill hole template 34. The electric drill may then be activated to create a refill hole on the toner hopper 33 where toner may be added. The refill hole template 34 preferably includes at least one collar 35 positioned within the interior perimeter of the refill hole template 34. The collar 35 may be of predetermined diameter and height and is preferably configured to control the depth of the cut of the hole saw. A plurality of collars with varying internal diameters and heights may be provided. Controlling the depth of the cut of the hole saw may substantially prevent the hole saw from damaging printer cartridge components. After the desired amount of toner has been added, the refill hole may be covered.

Figure 2:
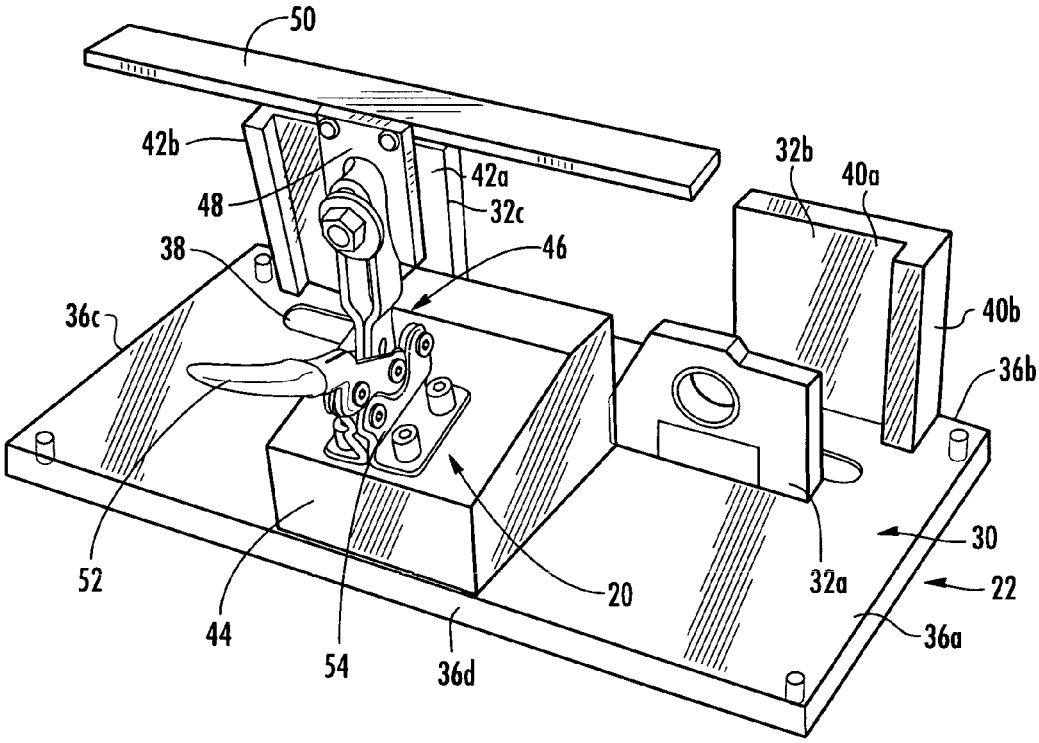
FIG. 2 is substantially a perspective view of an embodiment of the fixture and the seal clamp of the present invention.

Referring now to FIG. 2, the base 30 of the fixture 22 may include four sides 36*a-d*. A groove 38 preferably spans substantially from side 36*a* to 36*c* of the base 30. A portion of the printer cartridge 28 may be positioned within the groove 38 to further control the movement of the printer cartridge 28 during the sealing process or remanufacturing work. Other than the area of the base that defines the groove 38, the base 30 preferably defines a substantially planar surface. Fixture walls 32*a-c* preferably stand perpendicular from the base 30. Walls 32*b* and 32*c* may each be comprised of two walls (40*a* and 40*b*, 42*a* and 42*b*) that are attached substantially perpendicular to each other to form a corner, which would further control movements of the printer cartridge 28. All the walls 32*a-c* preferably cooperate to prevent the printer cartridge 28 from moving forward, backward, or side-to-side relative to the base 30.

It is noted that, terms relating to spatial orientation, such as "forward," "backward," and "side-to-side" are used herein for ease and clarity of description only. The invention is not limited by these spatial orientations and may be practiced without observing the descriptions that use these spatial orientations. The sizes, shapes, orientations, and positions of the walls or the groove may vary depending on the design of the printer cartridge or cartridge portion intended to be laid onto the base 30. In certain embodiments, the base may have indentations or holes in lieu of walls and that are configured hold the printer cartridge. It can be realized that the fixture 22 of the present invention affixes the printer cartridge to a substantially steady position, which may be ideal for performing manufacturing or remanufacturing work.

Seal

Figure 3:
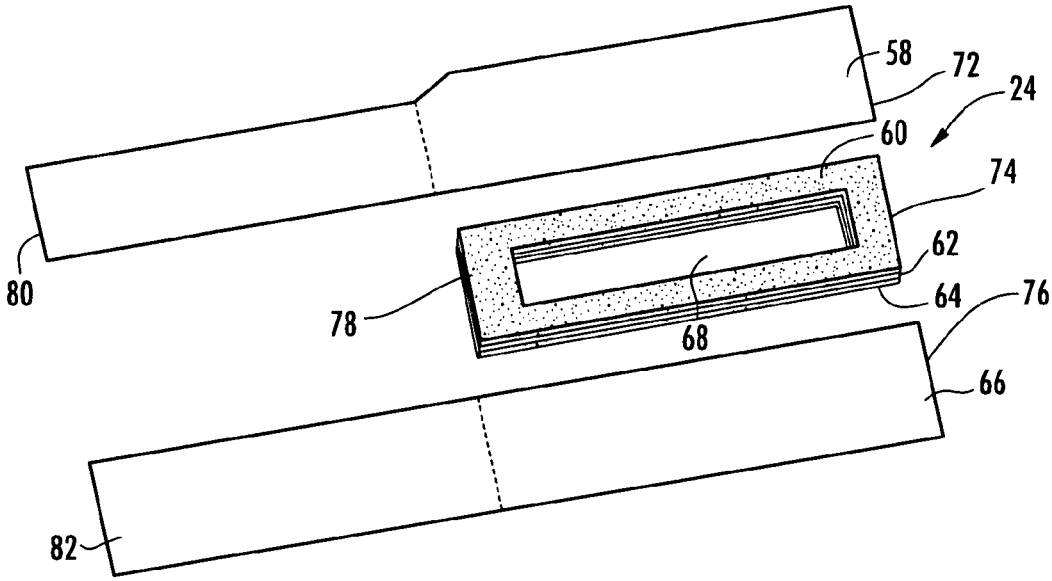
FIG. 3 is substantially an exploded view of a seal for use with the sealing methods of the present invention.

The present invention preferably includes the use of a toner opening port seal 24 shown in FIG. 3. The seal 24 preferably includes a first pull tab 58, a first adhesive 60, a seal frame 62, a second adhesive 64, and a second pull tab 66. The first pull tab 58, the seal frame 62, and the second pull tab 66 are preferably aligned on their respective ends 72, 74, and 76. The first pull tab 58 preferably comprises a sheet of sealing material made of plastic. A portion of the first pull tab 58 is preferably attached to the seal frame 62 using the first adhesive 60, which is preferably a hot melt adhesive. Hot melt adhesives bind objects together once they are subjected to a certain high environmental temperature. Once activated, hot melt adhesives continue to bind objects together even when the objects and the adhesives are no longer under high environmental temperature. The objects generally adhere together until the hot melt adhesive is exposed to ambient air. The hot melt adhesive usually gets exposed to ambient air when the objects are pulled apart from each other under ambient conditions. Hot melt adhesives are well known in the art and may be obtained from 3M Company of Saint Paul, Minn.

The seal frame 62 is preferably made of sheet of material that is more rigid than the first and second pull tabs. The seal frame 62 may also be made of plastic and preferably defines a seal frame window 68. The seal frame window 68 is preferably covered by the first pull tab 58 when the seal frame 62 and the first pull tab 58 are attached using the hot melt adhesive. The seal frame 62 is preferably configured to be positioned around the toner opening port such that the seal frame 62 surrounds the printer cartridge portion that defines the toner opening port, and the frame window 68 maintains the opening of the toner opening port. The first pull tab 58 that is attached to the seal frame 62 is preferably configured to cover the toner opening port prior to the use of the cartridge.

The seal frame 62 preferably includes a second adhesive 64, which is positioned on the surface of the seal frame 62 that is opposite to the seal frame surface where the first adhesive 60 is positioned. The second adhesive 64 is preferably made of different adhesive than the first adhesive 60. The second adhesive 64 may be a pressure sensitive adhesive, which may be obtained from 3M Company of Saint Paul, Minn. The second adhesive 64 is preferably configured to attach the second pull tab 66 to the seal frame 62.

The second pull tab 66 is preferably a sheet of material, such as paper, designed to prevent premature exposure of the second adhesive 64. The second adhesive 64 is preferably only exposed when the seal 24 is properly positioned around the toner opening port and ready to be attached to the printer cartridge. The second adhesive 64 is preferably exposed by detaching the second pull tab 66 from the seal frame 62 after the seal frame 62 has been inserted to the printer cartridge and the seal frame window 68 is aligned with the toner opening port. When the second pull tab 66 is detached from the seal frame 62, the second adhesive 64 preferably allows the seal frame 62 to adhere to the printer cartridge portion that defines the toner opening port. The seal clamp 20 may be used to press onto the seal frame 62 to allow the second adhesive 64 to attach the seal frame 62 uniformly and effectively to the printer cartridge.

Seal Insertion Tool

Figure 4:
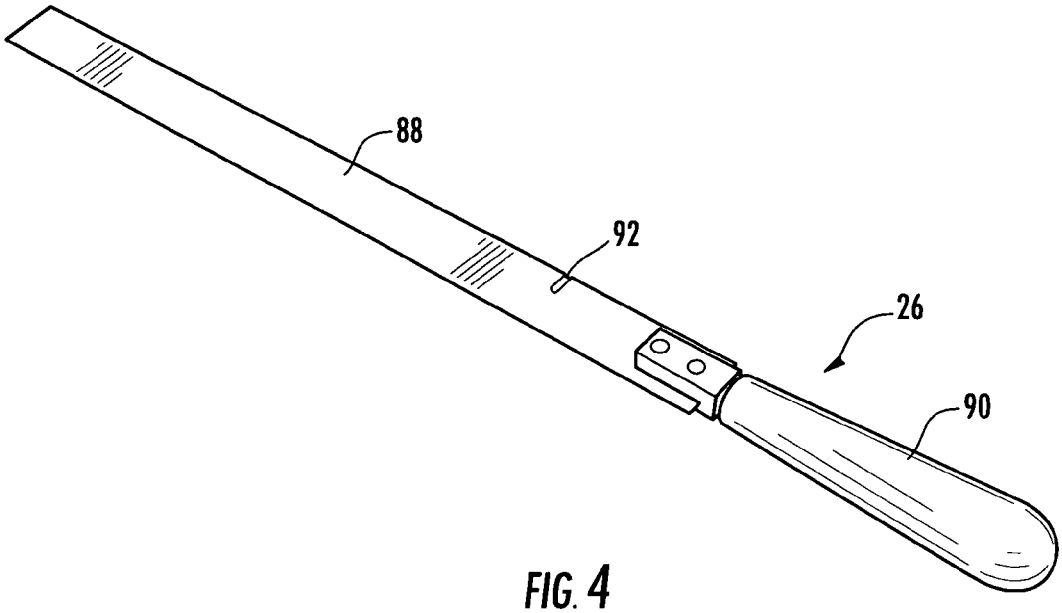
FIG. 4 is substantially a perspective view of a seal insertion tool of the present invention.

The present invention may include the use of a seal insertion tool 26 to aid in the insertion of the seal through the toner exit port 25. Referring now to FIG. 4, seal insertion tool 26 preferably includes a rigid member 88 with a predefined size and shape to fit through the toner exit port (not shown) and within the toner opening port area (not shown). The rigid member 88 may be made of metal or other materials known in the art. The rigid member 88 preferably has the rigidity needed to push the seal through the toner exit port. Attached to the rigid member 88 is preferably a handle 90, which may be grasped by a user to operate the insertion tool 26.

Figure 5:
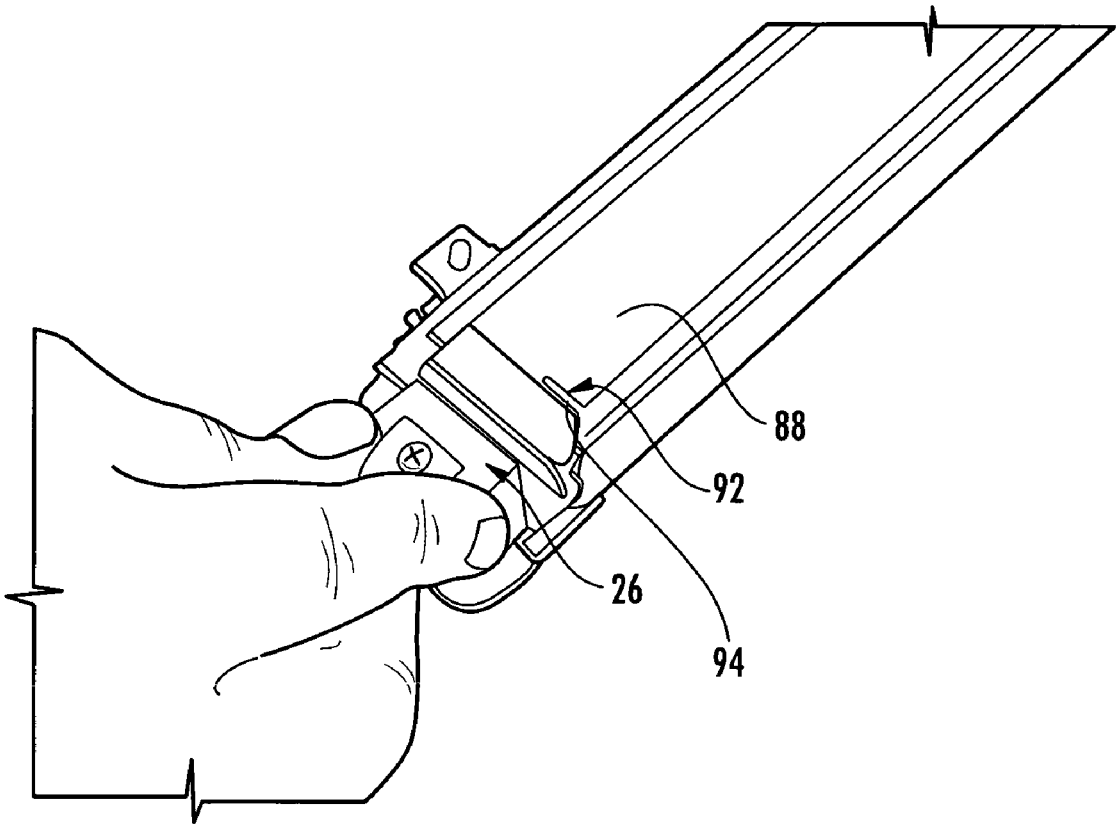
FIG. 5 is substantially a close up view of the seal insertion tool of FIG. 4.

Referring now to FIG. 5, the rigid member 88 of the seal insertion tool 26 preferably defines a notch 92. The notch 92 is preferably configured to accommodate a known printer cartridge protrusion 94 around the toner opening port, such as a boss, that may push the rigid member 88 up causing the rigid member 88 to sit unevenly on the printer cartridge portion around the toner opening port. It can be appreciated that notch 92 allows the rigid member 88 to sit flush on the printer cartridge so that when the seal clamp 20 is used to apply pressure on the rigid member 88, the rigid member 88 can effectively and evenly press on the seal frame 62 thereby allowing the seal 24 to adhere uniformly well to the printer cartridge 28.

Seal Clamp

The present invention preferably includes the use of a seal clamp configured to press onto the seal 24 to promote uniform and effective attachment of the seal to the printer cartridge. Referring back to FIG. 2, the seal clamp 20 is preferably attached to the fixture 22 via a seal clamp mount 44. Seal clamp 20 may be a "hold down action" clamp from De-Sta-Co of Birmingham, Mich. Seal clamp 20 may include a handle 52, a clamp arm 46, a clamp base 54, a first press arm 48, and a second press arm 50. The handle 52 and the clamp arm 46 preferably pivot around each other at the clamp base 54. The clamp arm 46 may be attached to the first press arm 48. The second press arm 50 may be perpendicularly positioned and attached to the first press arm 48.

FIG. 2 shows the handle 52 being at a deactivated position where the handle does not cause the second press arm 50 to exert any pressure or contact the seal. At the deactivated position: the handle 52 may be substantially away from the base 30; the clamp arm 46 and the first press arm 48 may be at an angle that is equal to or more than 90 degrees relative to the side of the base 30 where wall 32*a* is attached; and, the second press arm 50 may be positioned substantially away from the walls 32*a-c* and substantially parallel to the base 30.

The handle 52 may be moved from the deactivated position in FIG. 2 to an activated position by pushing down the handle 52 (see FIG. 1). At the activated position: the handle 52 preferably causes the second press arm 50 to exert pressure and contact the seal; the handle 52 is preferably closer to the base 30 than when at the deactivated position; the clamp arm 46 and the first press arm 48 are preferably less than 90 degrees relative to the base 30; and the second press arm 50 may be substantially perpendicular to the base 30. It can be appreciated that the seal clamp of the present invention provides a substantially uniform sealing pressure to cause substantially all the surfaces of the seal that is in contact with the printer cartridge to adhere well to the printer cartridge.

Figure 6:
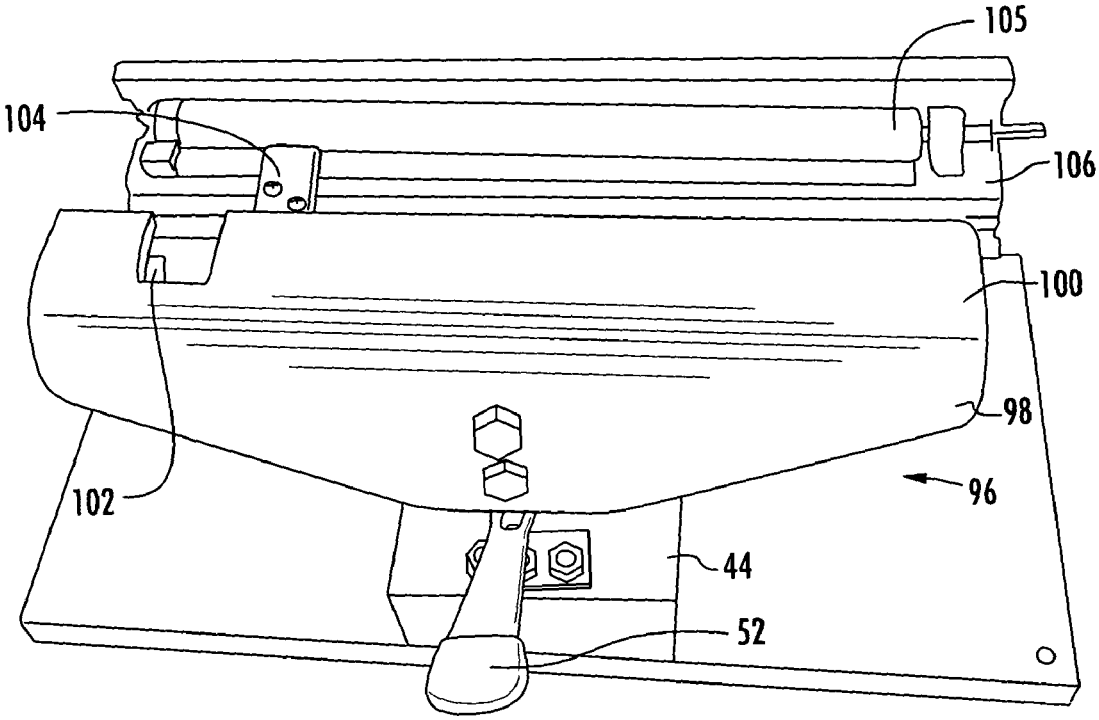
FIG. 6 is substantially a perspective view of another embodiment of the seal clamp of the present invention.

Referring now to FIG. 6, another embodiment 96 of a seal clamp is shown wherein, like seal clamp embodiment 20, seal clamp embodiment 96 is also mounted to the seal clamp mount 44. Seal clamp embodiment 96 also includes the same handle 52 and clamp arm (not shown). The differences between the seal clamp embodiment 96 and the seal clamp embodiment 20 are the design of their respective first press arm and second press arm. Specifically, the first press arm 98 and the second press arm 100 of the seal clamp embodiment 96 are part of a single plate that is curved to define the first press arm 98 and the second press arm 100. The first press arm 98 preferably defines a plane to which the plane defined by the second press arm 100 is substantially perpendicularly positioned. The second press arm 100 preferably defines a guide notch 102 to accommodate a seal guide 104. When the handle 52 is moved to an activated position, the second press arm 100 preferably gets inserted between an ad roller 105 and a cartridge portion 106 to contact the seal 24 and the seal insertion tool 26 (not shown in FIG. 3). The guide notch 102 preferably allows the second press arm 100 to accommodate the seal guide 104 to reach the seal and the seal insertion tool 26.

Figure 7:
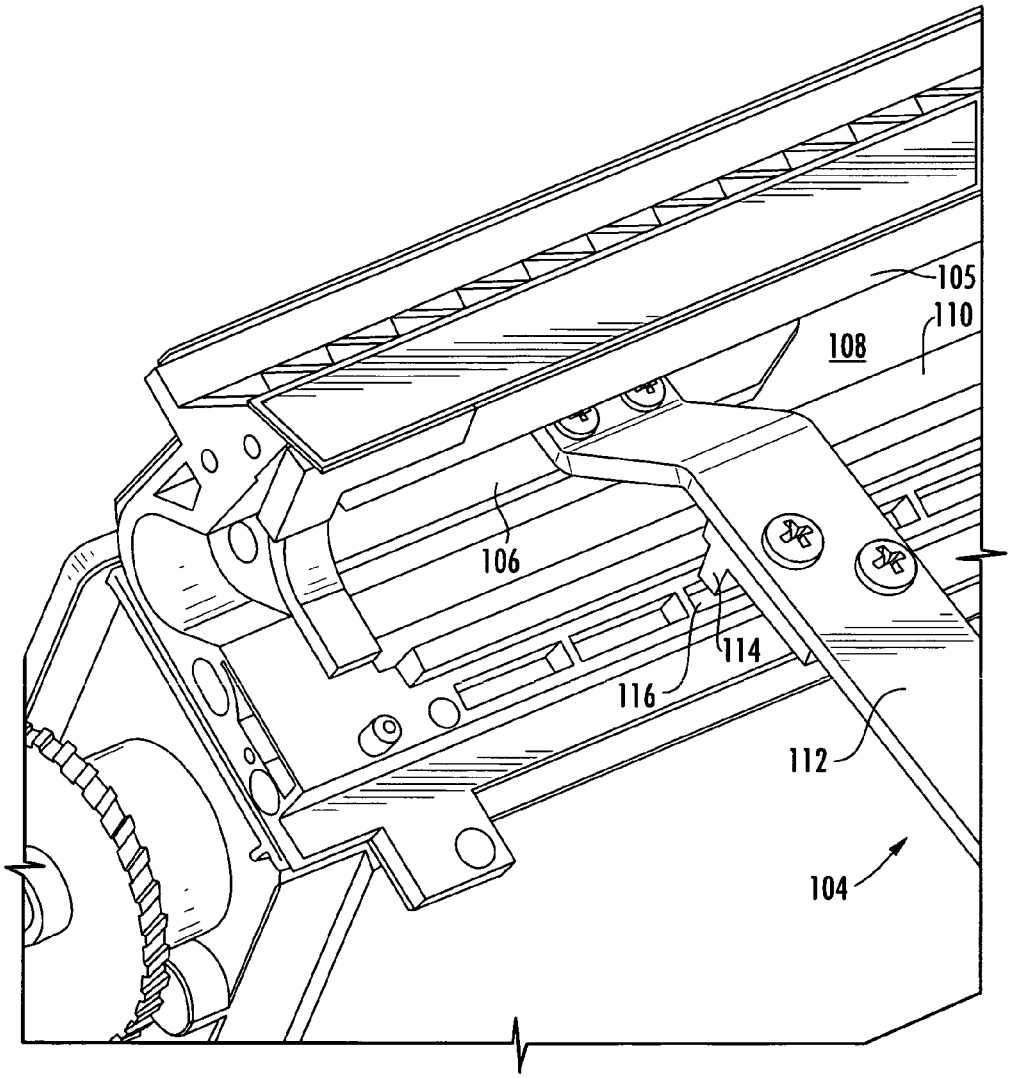
FIG. 7 is substantially a perspective view of a seal guide of the present invention.

Referring now to FIG. 7, the seal guide 104 may include a leveler portion 108 configured to be positioned on the corner of cartridge portion 106 that defines the toner opening port 110. The leveler portion 108 is preferably a flat piece of material, such as metal, and is preferably designed to press the seal 24 against the cartridge portion 106 so that the seal 24 may be efficiently attached to the cartridge portion 106 and effectively prevent toner leakage. A seal guide handle 112 may be attached to the leveler portion 108. A guide lock 114 may be provided below the guide handle 112 and may be designed to fit within one of the depressions 116 of the printer cartridge 28. The leveler portion 108 may be inserted under the ad roller 105, positioned on the corner of the cartridge portion 106, and locked by allowing the guide lock 114 to fit inside the depression 116.

Sealing Methods

Figure 8:
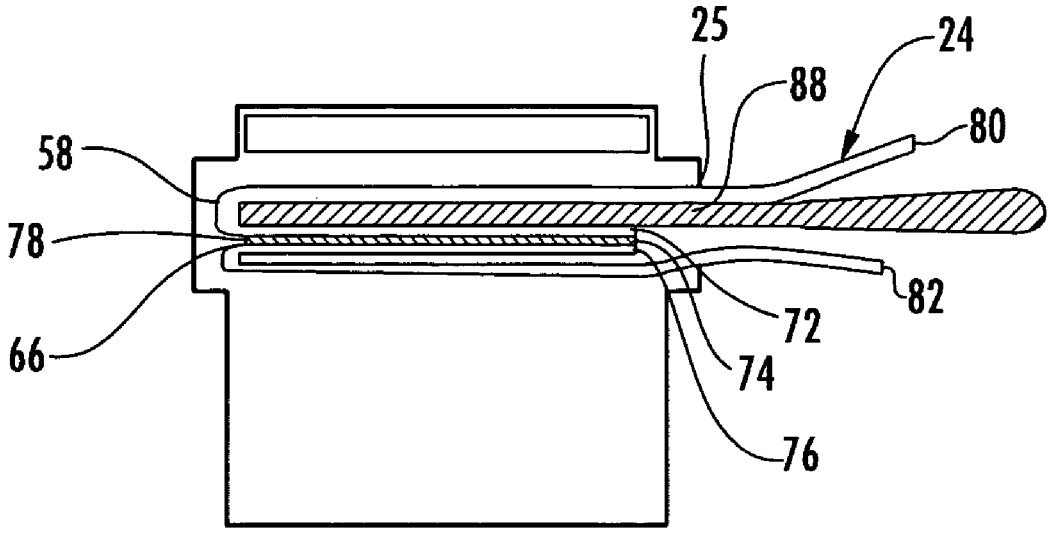
FIG. 8 is substantially a schematic cross-sectional view of the seal being inserted through the toner exit port using a toner opening port sealing method of the present invention.

Referring now to FIG. 8, seal 24 is preferably configured to be inserted through the toner exit port 25 of the printer cartridge. Rigid member 88 of the seal insertion tool 26 is preferably aligned with seal frame end 78. First pull tab 58 is preferably folded over insertion tool 26 such that a portion of the first pull tab 58 is positioned on top of the rigid member 88 insertion tool 26 and first pull tab end 80 exits toner exit port 25. Second pull tab 66 is preferably folded back such that the second pull tab end 82 is allowed to exit the toner exit port 25.

The insertion tool 26 and the seal 24 are preferably inserted through the toner exit port 25 and to the toner opening port area until they reach the end of the toner opening port area. The second pull tab 66 may then be detached from the seal frame 62 by pulling the second pull tab end 82 away from the printer cartridge. The detachment of the second pull tab 66 from the seal frame 62 exposes the second adhesive 64. The seal clamp 20 or 96 may then be used to uniformly press on the seal 24 and the seal insertion tool 26 to allow the second adhesive 64 to effectively attach the seal frame 62 to the printer cartridge 28. It is noted that the seal clamp 20 or 96 may be activated with or without the seal insertion tool 26 inside the printer cartridge.

The seal clamp 20 may be activated by pushing the handle 52, which preferably causes the second clamp arm 50 to pass through the toner adder roller (not shown) and the printer cartridge plastic (not shown). The second clamp arm 50 preferably contacts the first pull tab 58 and preferably applies pressure on the first pull tab 58, the seal insertion tool 26, the seal frame 62, and the second adhesive 64. It can be appreciated that the second clamp arm 50 provides substantially uniform pressure throughout its length and throughout the length of the rigid member 88 of the seal insertion tool 26.

In the alternative embodiment, seal clamp 96 and seal guide 104 may be used. The leveler portion 108 of the seal guide 104 may be inserted under the ad roller 105. The leveler portion 108 may be positioned on the corner of the cartridge portion 106 that defines the toner opening port and locked in place by allowing the guide lock 114 to fit inside the depression 116. The handle 52 of the seal clamp 96 may then be moved from the deactivated position to the activated position. The second press arm 100 may be allowed to go in between the ad roller 105 and the printer cartridge portion 106 with the guide notch 102 being able to accommodate the seal guide 104. The second press arm 100 may provide substantially uniform pressure throughout its length and throughout the length of the rigid member 88 of the seal insertion tool 26. The second press arm 100 may further provide the same pressure to the seal guide 104.

Figure 9:
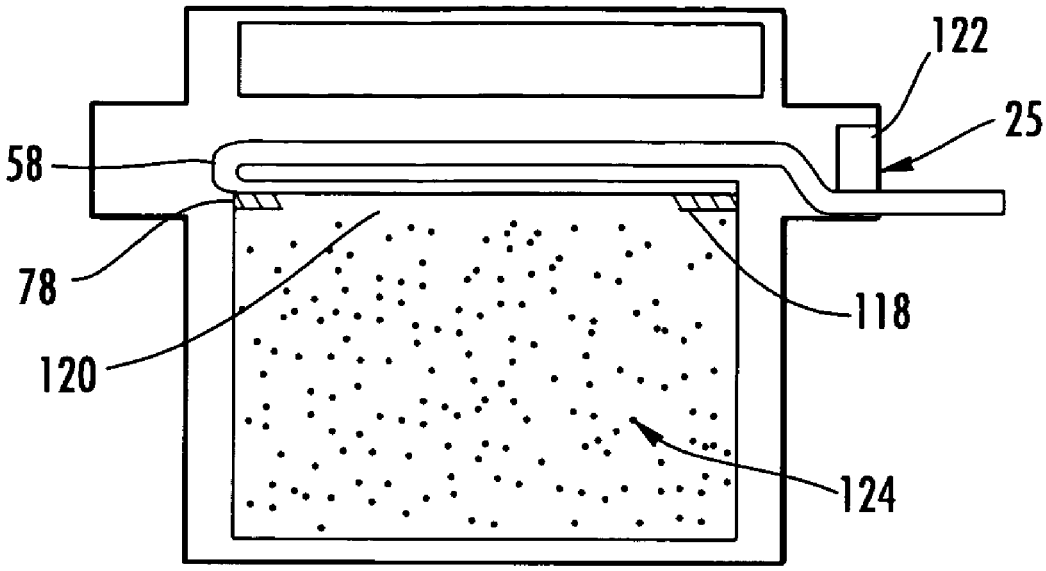
FIG. 9 is substantially a schematic cross-sectional view of the seal having been attached to the printer cartridge around the toner port opening.

Referring now to FIG. 9, after the seal frame end 78 is attached to the printer cartridge portion 118 surrounding the toner opening port 120, the first pull tab 58 is preferably configured to cover the toner opening port 120 until the cartridge is ready to be used. When the cartridge is ready to be used, the first pull tab 58 is configured to be detached from the cartridge to open the supply of toner 124. When the first pull tab 58 is detached from the cartridge, it goes through the toner exit port 25. The toner exit port 25 is typically covered by a toner exit port plug 122 to prevent toner leakage around the toner exit port 25. As the first pull tab 58 is pulled away from the seal frame end 78, the heat seal adhesive gets exposed to ambient air and gets deactivated. The first pull tab 58 substantially loses its ability to stick to the seal frame end 78 or adhere to any surface, including the toner exit port plug 122. It can be realized that when the first pull tab 58 passes through the toner exit port 25 and the toner exit port plug 122, the first pull tab 58 may not substantially adhere to the toner exit port plug 122. The heat sensitive adhesive helps prevent the first pull tab 58 from displacing the toner exit port plug 122, and thus helps prevent the toner from leaking around the toner exit port 25.

It can now be realized that the present invention provides apparatus and techniques for effectively sealing a toner opening port of a printer cartridge. The present invention provides a way of applying substantially uniform pressure to a toner opening port seal so that the seal may adhere very well around the toner opening port. A seal that adheres very well around the toner opening port can effectively prevent toner from exiting the toner opening port prior to the use of the printer cartridge. The present invention also provides apparatus and technique for providing a seal that would not displace a toner exit port plug when the seal is being detached from the printer cartridge. Thus, the present invention can prevent toner from further exiting the printer cartridge through the toner exit port. Finally, the present invention provides a fixture that provides ease during printer cartridge remanufacturing work, such as when sealing the printer cartridge, creating a toner refill hole, and refilling the cartridge with toner.

Although the description above contains many specifications, these should not be construed as limiting the scope of the invention but as merely providing illustrations of some of the presently preferred embodiments of this invention. For example, the shape of the base fixture may vary. Various clamp designs may be adopted. The invention is capable of other embodiments and of being practiced and carried out in various ways. The invention is not limited in its application to the details of the construction and to the arrangement of the components set forth in the above description or as illustrated in the drawings.

What is claimed is:

1. A method of sealing a toner opening port of a printer cartridge, the toner opening port being defined by a printer cartridge portion, the toner opening port being accessible from a toner exit port, the toner exit port being configured to be covered by a toner exit port plug, the method comprising:

a. providing a seal, the seal comprising:
   i. a seal frame comprising a first side and a second side, the second side being positioned opposite the first side;
   ii. a first pull tab attached to the first side, a portion of the first pull tab being configured to cover the toner opening port;
   iii. a heat sensitive adhesive in between the first side and the first pull tab;
   iv. a second pull tab attached to the second side, the second pull tab being attached to the second side by a pressure sensitive adhesive;
b. inserting the seal through the toner exit port with the second pull tab folded back such that the second pull tab end is allowed to exit the toner exit port;
c. removing the second pull tab from the seal;
d. allowing the first pull tab to cover the toner opening port;
e. covering the toner exit port with the toner exit port plug to prevent toner leakage around the toner exit port.

2. The method of claim 1, further comprising:
a. providing a substantially rigid seal insertion tool; and,
b. pushing the seal through the toner exit port using the substantially rigid insertion tool.

3. The method of claim 2, further comprising pressing on the seal insertion tool to allow the pressure sensitive adhesive to adhere to the printer cartridge.

4. The method of claim 3, further comprising:
a. defining a notch on the rigid seal insertion tool; and,
b. accommodating a protrusion on the printer cartridge portion that defines the toner opening port with the notch.

5. The method of claim 1, further comprising providing a seal clamp for pressing on the seal to allow the seal to adhere to the printer cartridge.

6. The method of claim 1, further comprising:
a. providing a base;
b. supporting the printer cartridge with the base;
c. providing a plurality of walls on the base; and,
d. controlling movement of the cartridge with the plurality of walls.

7. The method of claim 1, further comprising:
a. providing a base;
b. supporting the printer cartridge with the base;
c. providing a wall that defines a toner refill hole template; and
d. positioning the toner refill hole template adjacent to a toner hopper of the printer cartridge.

8. The method of claim 1, wherein the second pull tab is paper.

9. The method of claim 1, wherein the first pull tab is plastic.

10. A method of sealing a toner opening port of a printer cartridge, the method comprising:
a. inserting a seal through a toner exit port, the toner exit port leading to the toner opening port, the toner exit port being configured to be covered by a toner exit port plug, the seal comprising a seal frame and a first pull tab attached to the seal frame with a first adhesive, the seal further comprising a second pull tab attached to the seal frame with a second adhesive, the second adhesive being a different type of adhesive from the first adhesive;
b. detaching the second pull tab from the seal;
c. allowing the first pull tab to cover the toner opening port; and,
d. applying pressure with a seal clamp to the seal thereby allowing the seal to attach to the printer cartridge.

11. The method of claim 10, further comprising supporting the printer cartridge with a fixture, the fixture comprising a base and a plurality of walls attached to the base, the plurality of walls configured to substantially control movement of the printer cartridge.

12. The method of claim 10, further comprising leveling at least a portion of the first pull tab when it is positioned around the toner opening port.

* * * * *